US005702137A

United States Patent [19]

Gutierrez

[11] Patent Number: 5,702,137

[45] Date of Patent: Dec. 30, 1997

[54] STAFF OR STICK FOR RECOLLECTING ORGANIC WASTE FROM DOMESTIC ANIMALS SUCH AS DOGS AND CATS

[76] Inventor: José Núñez Gutierrez, Bosques del Rayo No. 19, Col. La Herradura, 53920 Naucalpan, Edo de México, Mexico

[21] Appl. No.: 690,679

[22] Filed: Jul. 31, 1996

[30] Foreign Application Priority Data

Jul. 31, 1995 [MX] Mexico ..... 95 234

[51] Int. Cl.[6] ..... A01K 29/00; E01H 1/12

[52] U.S. Cl. ..... 294/1.4; 294/115

[58] Field of Search ..... 294/1.3–1.5, 19.1, 294/50.8, 55, 115; 15/104.8, 257.1, 257.6, 257.7

[56] References Cited

U.S. PATENT DOCUMENTS

| | | | |
|---|---|---|---|
| 3,733,098 | 5/1973 | Tobias | 294/1.4 |
| 3,929,363 | 12/1975 | Kahan | 294/1.4 |
| 4,014,584 | 3/1977 | Bau | 294/1.4 |
| 4,247,139 | 1/1981 | Grieb | 294/1.4 |
| 5,056,842 | 10/1991 | Lindenberg et al. | 294/1.4 |
| 5,326,143 | 7/1994 | Babler | 294/1.4 |

*Primary Examiner*—Dean Kramer

*Attorney, Agent, or Firm*—Baker & Daniels

[57] ABSTRACT

A utility model of a staff for collecting wastes of domestic animals such as dogs and cats, which consists of a tubular socket with another interior tube and a central rod with handles which operate with springs and with several hinges fastened to a box in the lower part of the staff with two side bolts and one central bolt which go through holes made in the base of the container which recollects the waste by activating the handles which release the hinges with which the container is closed, which is released by activating the handle on the central rod.

2 Claims, 7 Drawing Sheets

STAFF OR STICK FOR RECOLLECTING ORGANIC WASTE FROM DOMESTIC ANIMALS SUCH AS DOGS AND CATS

BACKGROUND OF THE INVENTION

The object of the present invention is to provide a staff for collecting organic waste from domestic animals such as dogs and cats.

In many countries it is prohibited to leave dog waste in public rights of way, and if this is done, a fine is charged to the animal's owner. Even in those countries where this act is not punishable, civic sense tells us that it is not very healthy to leave such wastes in the open air due to the serious problems of pollution that such wastes can cause.

SUMMARY OF THE INVENTION

With the staff of the present invention, the problems cited above are avoided in a simple, practical and ecologically favorable manner.

The inventive staff consists of a tubular socket through which another tube is pulled, and inside of all this is a rod. By means of a plurality of levers which operate with springs and a pair of hinges, a container is held in the lower part of the staff and the animal waste is collected. The container then closes and is thereafter released from the staff. The waste is then eliminated by placing the container into a trash receptacle. By making the container from a degradable material, for example cardboard, an ecological balance is maintained.

BRIEF DESCRIPTION OF THE DRAWINGS

These and other characteristics of the invention shall be described in more detail in combination with the attached drawings, in which.

DETAILED DESCRIPTION OF THE INVENTION

Figure 1:
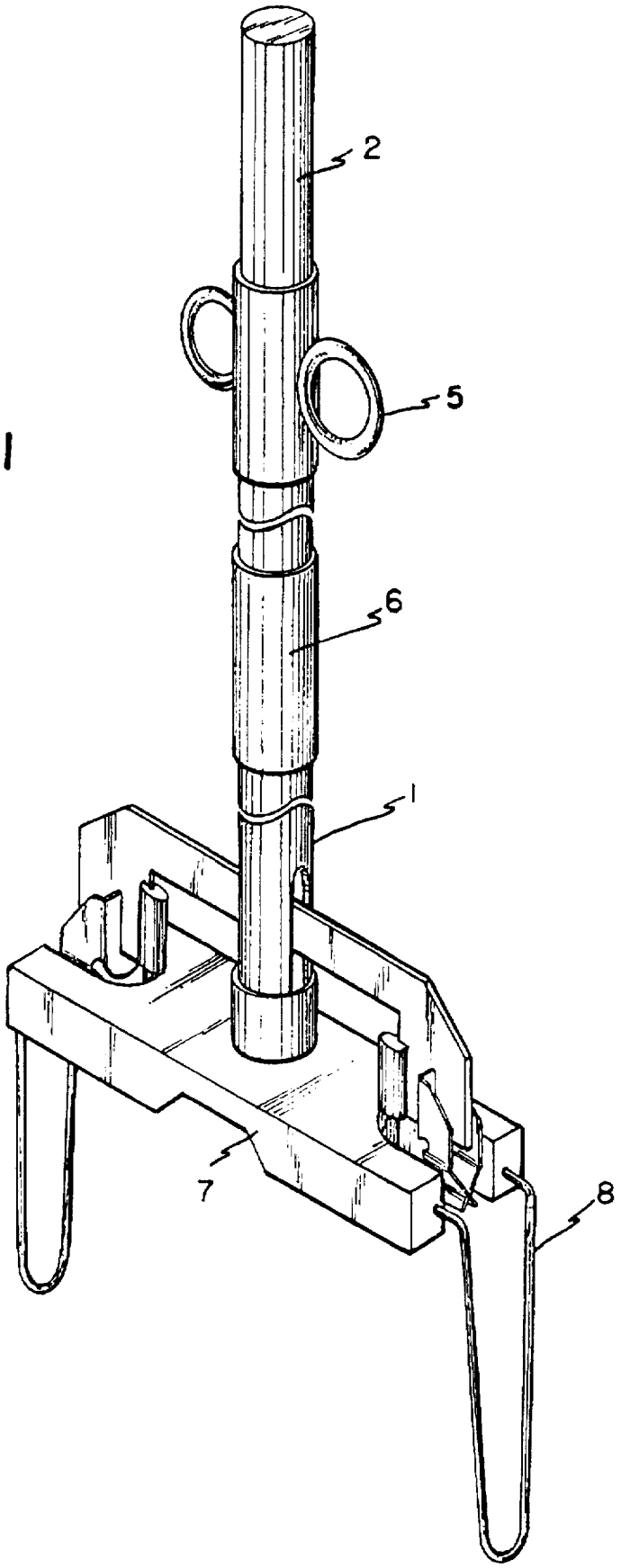
FIG. 1 is a perspective view of the staff.
Figure 2:
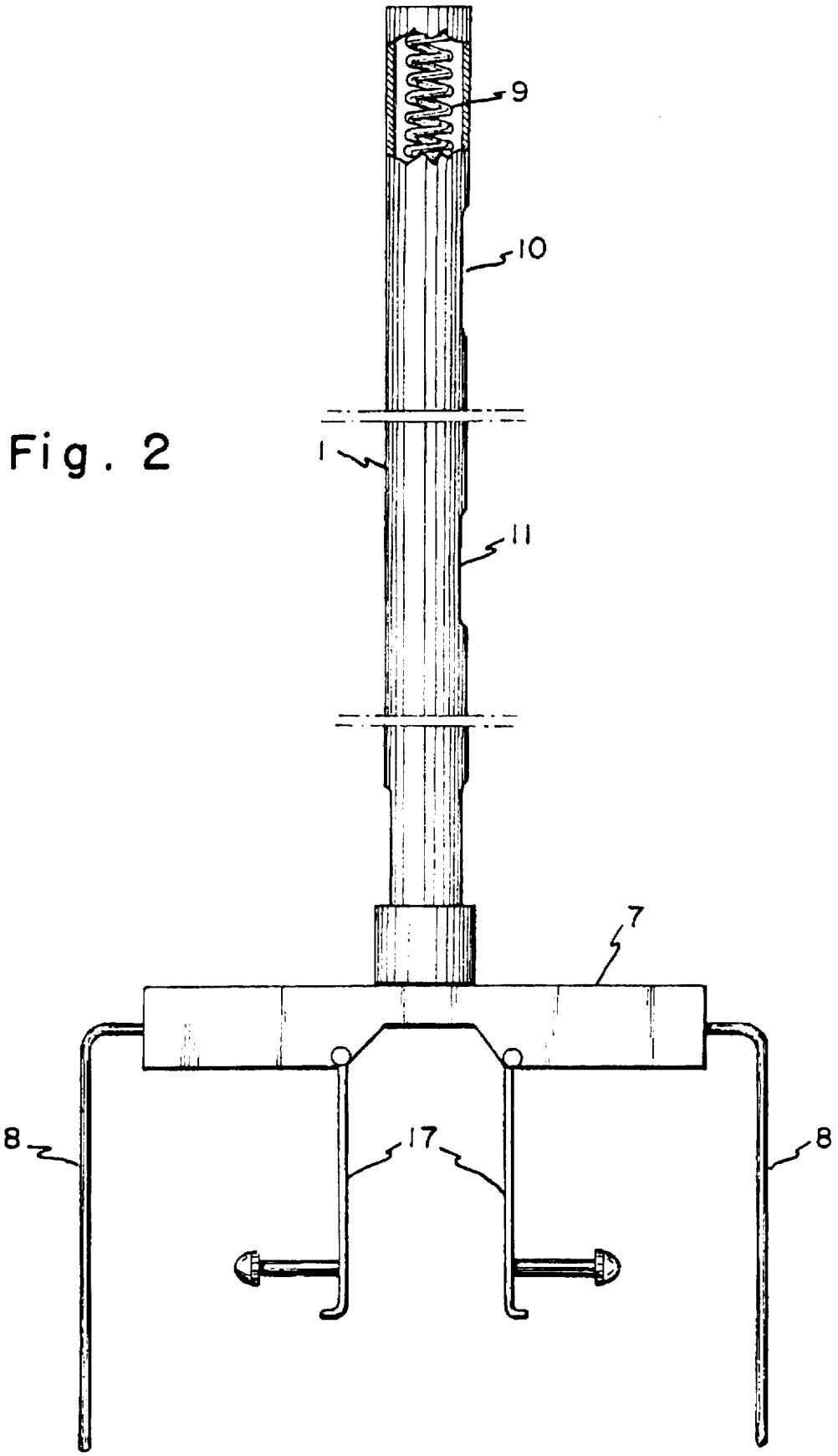
FIG. 2 is a view of the staff, showing the exterior tube.
Figure 3:
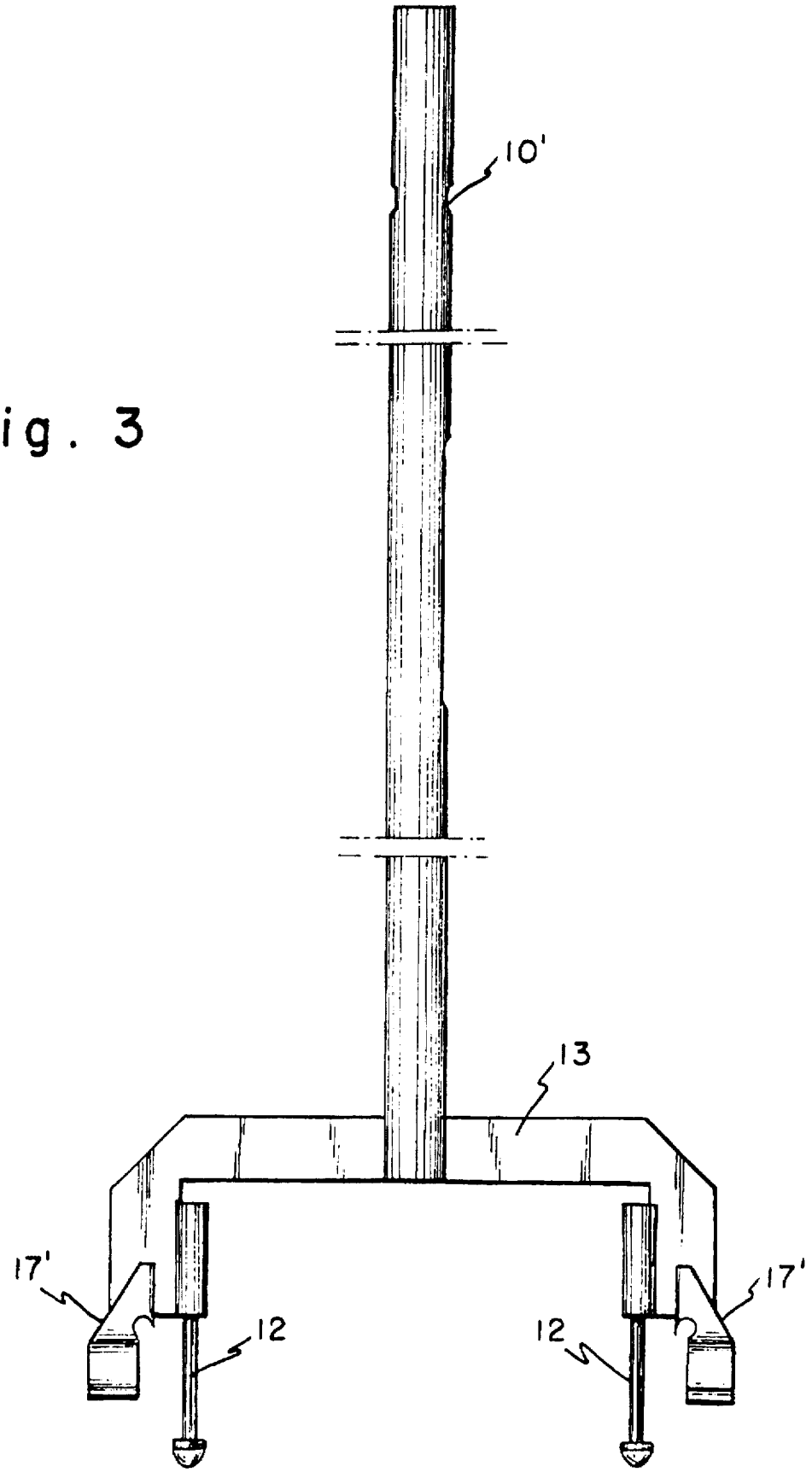
FIG. 3 is a view showing the central tube.

Referring now to the drawings, staff 1 has an interior tube 2 with a handle 5 in the form of scissors and a handle 6 in the central part. The staff has a base with two push buttons 8. The exterior socket or tube 2 (FIGS. 2 and 3) has a spring 9 in the upper part of the shank, and a groove 10 for the handle or crank to pass through. In the middle there is another groove 11 for the container release handle. In groove 10 there is an operating bolt 10'. The lower part has two bolts 12, which stand out from a frame 13. These bolts pass through holes in the container which shall be described hereinafter.

Figure 4:
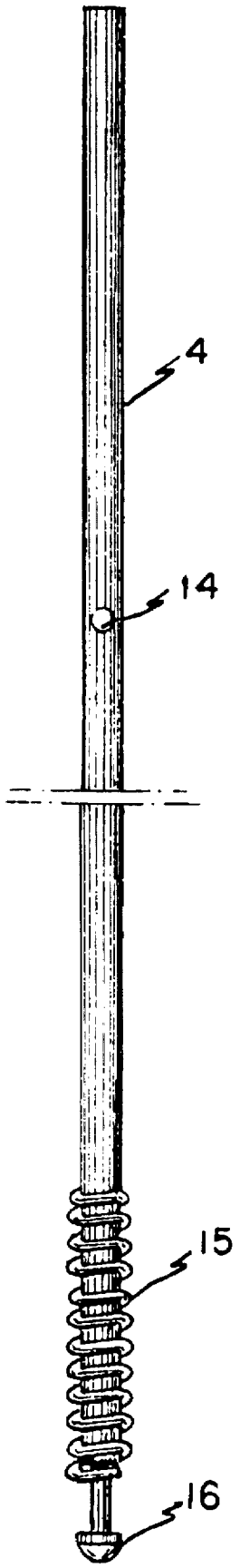
FIG. 4 is a view of the interior rod.

The interior control rod 4 (FIG. 4) has a tap 14 in the top, a spring 15 at the bottom and ends in a bolt 16 which goes through the central hole in the container.

Figure 5:
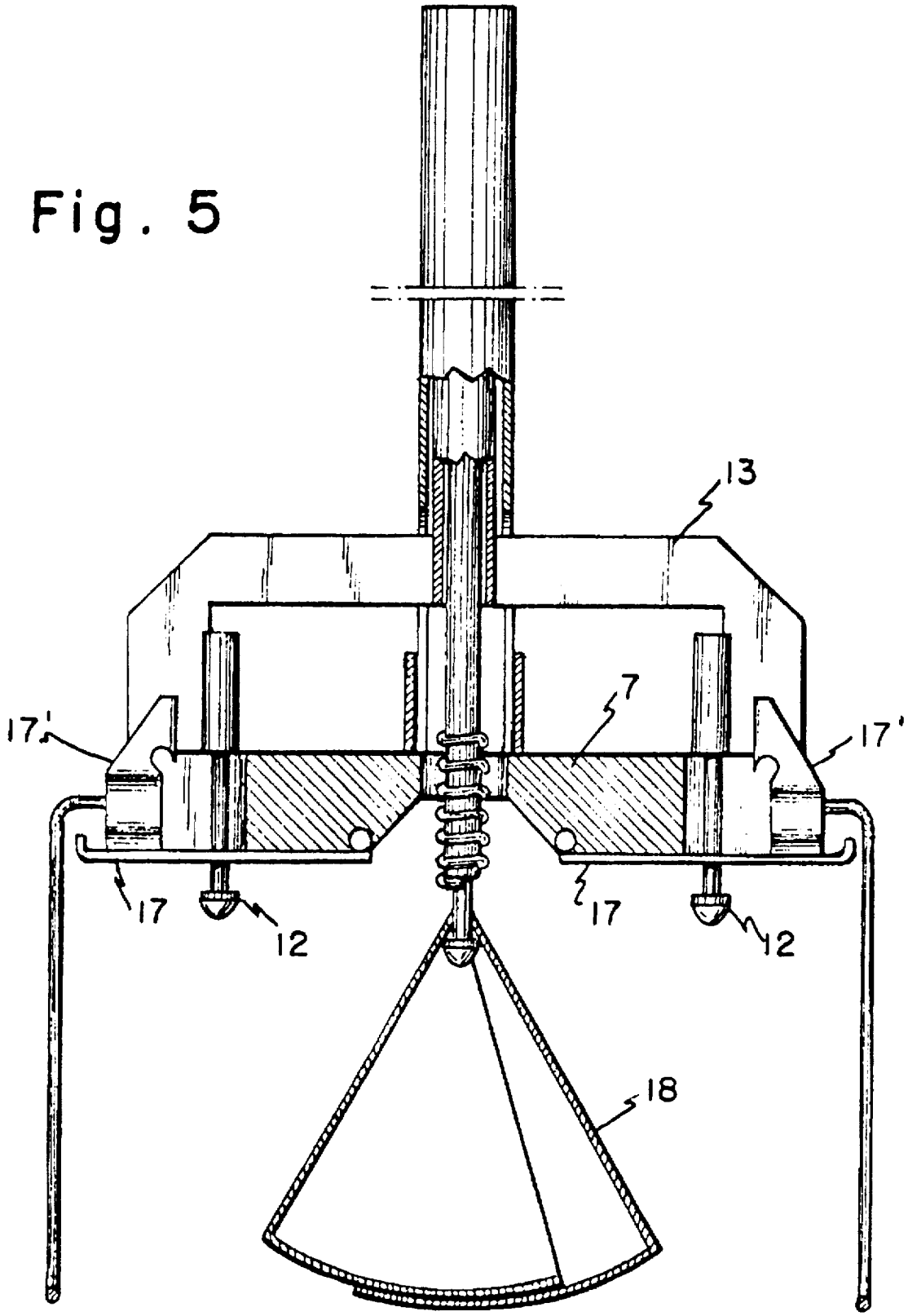
FIG. 5 is an enlargement of the container holding section.
Figure 6:
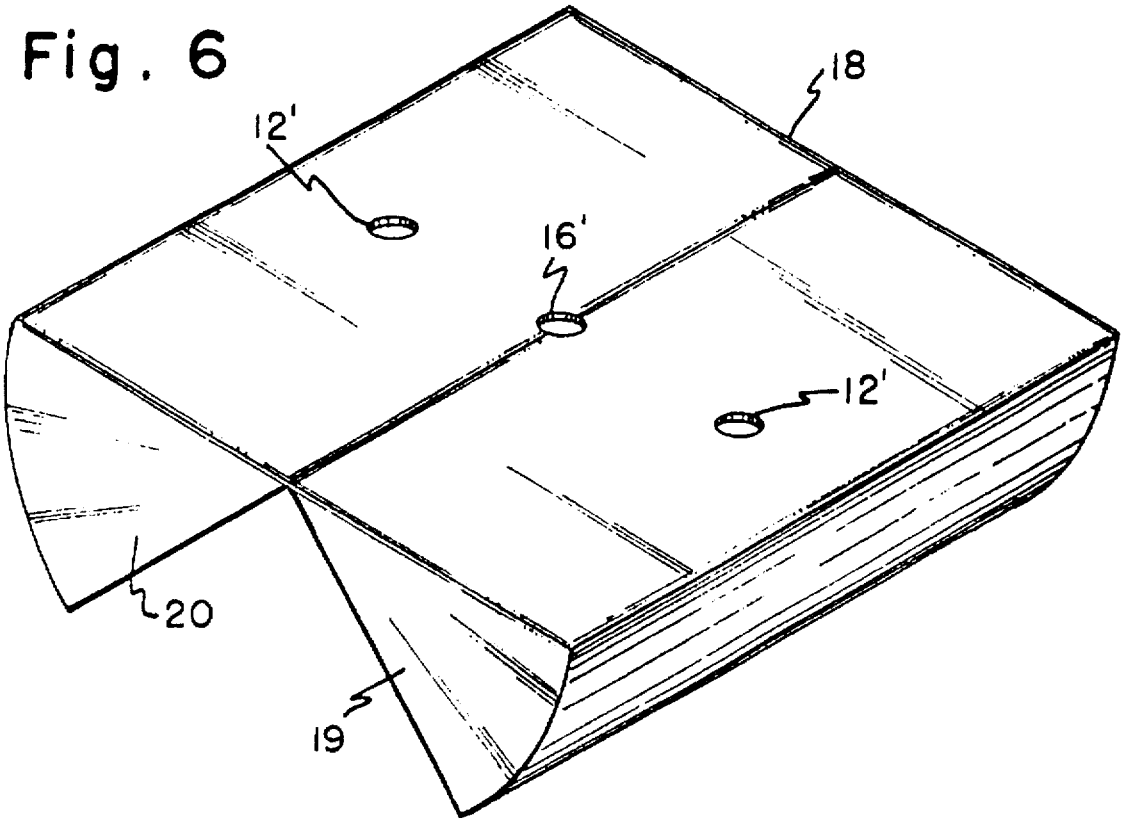
FIG. 6 is a perspective view of the open container.

FIG. 5 illustrates how container 18 is held. Frame 13 has two bolts 12 which are received inside a pair of hinges 17. Hinges 17 are fastened to the base 7 by a convenient method, for example with lyre-type clasps. Bolts 12 go through the holes 12' which are in the container 18 (FIG. 6). Bolt 16 of the control rod 4 goes through the central hole 16' of the container.

In operation, the container 18 is opened with holes 12' and 16' passing through the respective bolts, hinges 17 being fastened to the lyre-type clasps 17'. When animal waste is to be collected, the handle 5 is activated which releases the hinges 17, and closes the container 18 on the waste. To release the container the handle or crank 6 is activated which activates the spring 15.

Figure 7:
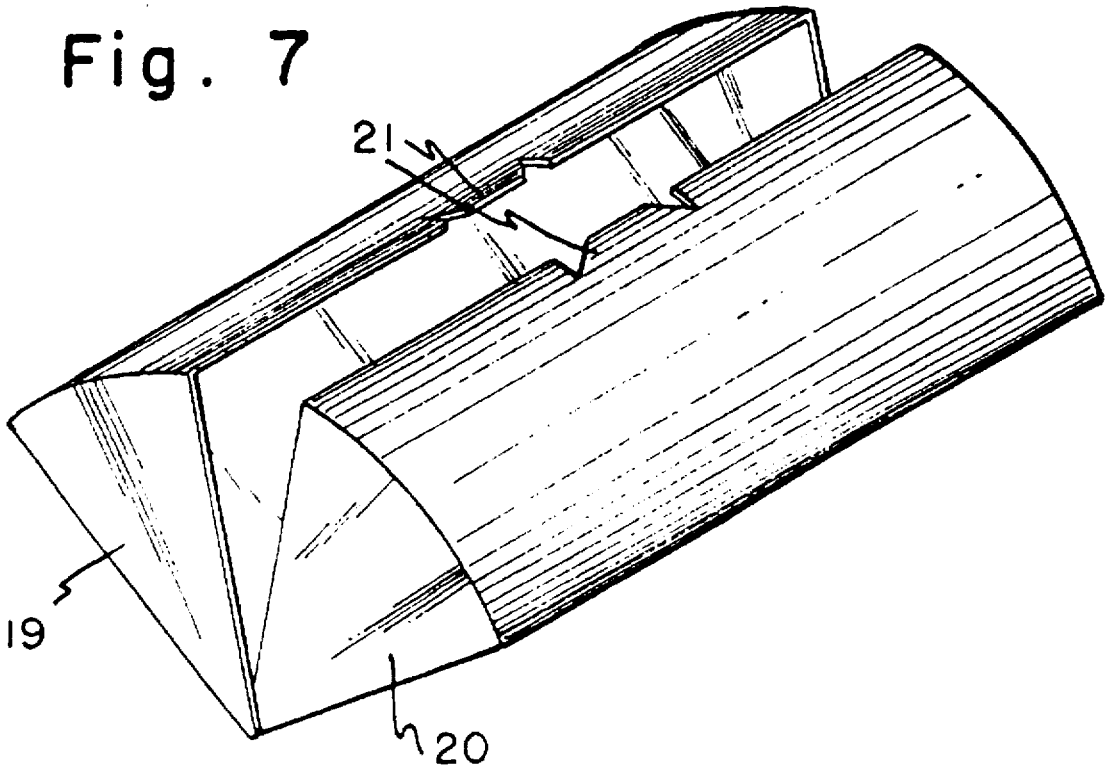
FIG. 7 is a perspective view of the half-closed container.

The container 18 has a section 19 which is slightly bigger than the section 20 (FIGS. 6 and 7) so that one may enter inside the other, and it has lugs 21 for adjustment of the closing.

The containers may be provided in cylindrical packets as several can be placed at the same time, one inside the other and as they form a quarter cylinder, several can be accommodated so as to form this geometric figure.

What is claimed is:

1. A staff assembly for collecting the waste of domestic animals in a container, said staff assembly comprising:

an external tubular socket;

an internal tube positioned within the external tubular socket;

a base positioned at a lower portion of said tubular socket;

a central rod positioned within the internal tube, said central rod having a central bolt and a spring at an end thereof, said central rod and spring extending through a hole in said base;

a crank for activating the central bolt and spring;

handle and spring means coordinated with said tubular socket; and a plurality of hinges releasably fastened to an underside of said base via respective side bolts; wherein said hinges, side bolts and central bolt are structured and arranged such that a container for collecting waste is held in an opened condition thereby, said tubular socket being coordinated with said handle and spring means and with said plurality of hinges such that upon activation of said handle and spring means the hinges are released, thereby closing the container on the waste; said central rod and spring being coordinated with said crank such that upon activation of said crank said central rod and spring release said container from said staff.

2. The staff of claim 1, wherein the hinges are releasably fastened to the base by lyre-type clasps.

* * * * *